US009951555B2

(12) United States Patent
Klein Tuente et al.

(10) Patent No.: US 9,951,555 B2
(45) Date of Patent: Apr. 24, 2018

(54) DEVICE FOR MOUNTING A SHAFT OF A SCREEN ON A SURFACE

(71) Applicant: Coulisse B.V., Enter (NL)

(72) Inventors: Bastiaan Franciscus Klein Tuente, Groenlo (NL); Ruben Hubert Jan de Vries, Zevenaar (NL); Thomas Johan Maria Ter Haar, Hengelo (NL); Harry Davids, Raalte (NL)

(73) Assignee: COULISSE B.V., Enter (NL)

( * ) Notice: Subject to any disclaimer, the term of this patent is extended or adjusted under 35 U.S.C. 154(b) by 0 days.

(21) Appl. No.: 14/686,865

(22) Filed: Apr. 15, 2015

(65) Prior Publication Data

US 2015/0300085 A1 Oct. 22, 2015

(30) Foreign Application Priority Data

Apr. 16, 2014 (NL) ..... 2012642

(51) Int. Cl.
*E06B 9/42* (2006.01)
*E06B 9/50* (2006.01)
*A47H 1/142* (2006.01)

(52) U.S. Cl.
CPC ..... *E06B 9/42* (2013.01); *A47H 1/142* (2013.01); *E06B 9/50* (2013.01); *Y10T 403/60* (2015.01); *Y10T 403/606* (2015.01)

(58) Field of Classification Search
CPC ... E06B 9/50; E06B 9/42; A47H 1/142; Y10T 403/606; Y10T 403/60
USPC ..... 248/262, 267, 268, 269, 271, 251; 160/84.02, 121.1, 178.1 R, 178.1 V, 160/323.1, 902, 903
See application file for complete search history.

(56) References Cited

U.S. PATENT DOCUMENTS 548,927 A * 10/1895 Popper ..... A47H 1/13 248/255
839,959 A * 1/1907 Richards ..... A47H 1/142 248/262
845,935 A * 3/1907 Dolson et al. ..... A47H 1/13 248/254
1,036,717 A * 8/1912 Roberts ..... A47H 1/13 248/254
1,127,459 A * 2/1915 Laun ..... A47H 1/142 248/262

(Continued)

FOREIGN PATENT DOCUMENTS

EP 1106775 A1 6/2001

OTHER PUBLICATIONS

Supplementary European Patent Office Search document, Application No. 15 163 836.8, dated May 11, 2016.

(Continued)

*Primary Examiner* — Kimberly T Wood
(74) *Attorney, Agent, or Firm* — Oppedahl Patent Law Firm LLC

(57) ABSTRACT

The present invention relates to a device for mounting a shaft of a screen, such as a window covering, on a surface such as a wall, window frame or a ceiling, wherein the device comprises a mounting bracket and a shaft holder, wherein the mounting bracket is configured for mounting on the surface and the shaft holder is attachable to the mounting bracket, wherein the shaft holder is provided with coupling means for coupling the shaft and the shaft holder in releasably attachable manner to the mounting bracket.

5 Claims, 5 Drawing Sheets

(56) References Cited

U.S. PATENT DOCUMENTS

| | | | | | |
|---|---|---|---|---|---|
| 1,156,076 | A * | 10/1915 | Henry | A47H 1/142 | 16/94 D |
| 1,220,158 | A * | 3/1917 | Edsall et al. | A47H 1/142 | 248/262 |
| 1,480,800 | A * | 1/1924 | Wait | A47H 1/142 | 248/262 |
| 1,649,214 | A * | 11/1927 | Boye | A47H 1/142 | 248/262 |
| 1,713,531 | A * | 5/1929 | Henry | A47H 1/142 | 116/34 R |
| 1,812,857 | A * | 7/1931 | Brunner | A47H 1/022 | 248/262 |
| 1,816,824 | A * | 8/1931 | Brunner | A47H 1/142 | 248/262 |
| 2,552,180 | A * | 5/1951 | Kenney | A47H 1/142 | 248/262 |
| 2,682,385 | A * | 6/1954 | Schluter | A47H 1/142 | 248/216.4 |
| 4,751,953 | A * | 6/1988 | Appel | E06B 9/50 | 160/313 |
| 4,824,062 | A | 4/1989 | Wagner | | |
| 5,473,797 | A * | 12/1995 | Wu | E06B 9/326 | 160/178.1 R |
| 6,438,808 | B1 * | 8/2002 | Kung | A45F 5/02 | 24/3.11 |
| 6,561,475 | B1 * | 5/2003 | Chuang | A47H 1/144 | 160/330 |
| 7,267,311 | B2 * | 9/2007 | Jung | E06B 9/50 | 160/903 |
| 7,380,582 | B1 * | 6/2008 | Anderson | E06B 9/34 | 160/323.1 |
| 8,122,932 | B2 * | 2/2012 | Cannaverde | E06B 9/174 | 160/120 |
| 2004/0065797 | A1 * | 4/2004 | Bell | A47H 1/022 | 248/262 |
| 2005/0183835 | A1 * | 8/2005 | Nien | E06B 9/50 | 160/321 |
| 2008/0121353 | A1 * | 5/2008 | Detmer | E06B 9/72 | 160/266 |
| 2011/0108694 | A1 * | 5/2011 | Chen | E06B 9/50 | 248/261 |

OTHER PUBLICATIONS

European Search Report for application EP 15 16 3836, completed Aug. 4, 2015.

* cited by examiner

DEVICE FOR MOUNTING A SHAFT OF A SCREEN ON A SURFACE

The present invention relates to a device for mounting a shaft of a screen, such as a window covering, on a surface such as a wall, window frame or a ceiling, wherein the device comprises a mounting bracket and a shaft holder, wherein the mounting bracket is configured for mounting on the surface and the shaft holder is attachable to the mounting bracket, wherein the shaft holder is provided with coupling means for coupling the shaft and the shaft holder in releasably attachable manner to the mounting bracket.

Such a device is known in the field. The known device comprises a mounting bracket and a shaft holder. The mounting bracket comprises rectangular holes and the shaft holder comprises corresponding hooks. During attachment of the shaft holder to the mounting bracket the hooks drop into the holes of the shaft holder.

The known device has the drawback that the attachment of the shaft holder to the mounting bracket is difficult in some situations, particularly in those situations where the mounting bracket is situated in a deep recess. Other drawbacks are related to the use in the known device of a resilient element which is necessary to prevent the shaft holder unintentionally detaching from the mounting bracket during use. The known device is complex because of the resilient element, which itself forms an additional component. The resilient element moreover applies counter-pressure in axial direction and so causes permanent friction. The known device further provides fewer possibilities for compensating fitting dimension tolerance.

A device according to the preamble of claim 1 is known from the U.S. Pat. No. 7,380,582B1.

The present invention has for its object to provide a device of the type stated in the preamble which obviates this drawback. The device according to the invention has for this purpose the feature that the mounting bracket is provided with at least one locking tooth and the shaft holder is provided with at least one slot, wherein each slot is configured to receive one of the locking teeth and the shaft holder and the mounting bracket are provided with co-acting locking means for releasably locking the at least one locking tooth in the slot.

The device according to the invention makes it possible to attach the shaft holder more easily to the mounting bracket than in the known device because the shaft holder can be attached slidably to the mounting bracket in a plane at least perpendicularly of the surface or in a plane at least perpendicularly of the shaft of the screen. In the inventive device the shaft holder is hereby easy to couple to the mounting bracket in any situation. A resilient element is not required here for retention in axial direction as in said known device.

The invention has the inventive feature that the shaft holder comprises an end plate which is arranged at a distance on the shaft holder using two or more spacers such that a space between mutually adjacent spacers forms a slot.

In a practical embodiment of the device according to the invention the end plate is provided at the position of at least one slot with a controllable hook, and the locking tooth is provided with a hole intended for the purpose of at least partially receiving the hook. The co-acting locking means are formed in this embodiment by the hook and the hole. The rigid locking means are arranged on the mounting bracket and the movable locking means are arranged on the shaft holder in advantageous manner.

The controllable hook is preferably arranged on a tongue in the end plate, whereby the hook can be unlocked by means of operating the tongue. In contrast to the prior art device, no additional components are necessary for this purpose.

In a preferred embodiment of the device according to the invention the at least one locking tooth is part of a fork with a plurality of teeth, wherein the other teeth are guide teeth intended for the purpose of guiding the shaft holder in the mounting bracket. The guide teeth function here as positioner for placing a locking tooth in a slot.

In the preferred embodiment the guide teeth are preferably configured for co-action with the outer spacers.

The guide teeth can be configured in the device according to the invention for co-action with a cap which largely conceals the mounting bracket from view.

The mounting bracket is preferably punched out of steel plate.

The invention will now be described in more detail with reference to the figures, in which FIG. 1 is an isometric view of a first preferred embodiment of a device according to the invention applied in a roller blind;

The same components are designated in the different figures with the same reference numerals.

Figure 1:
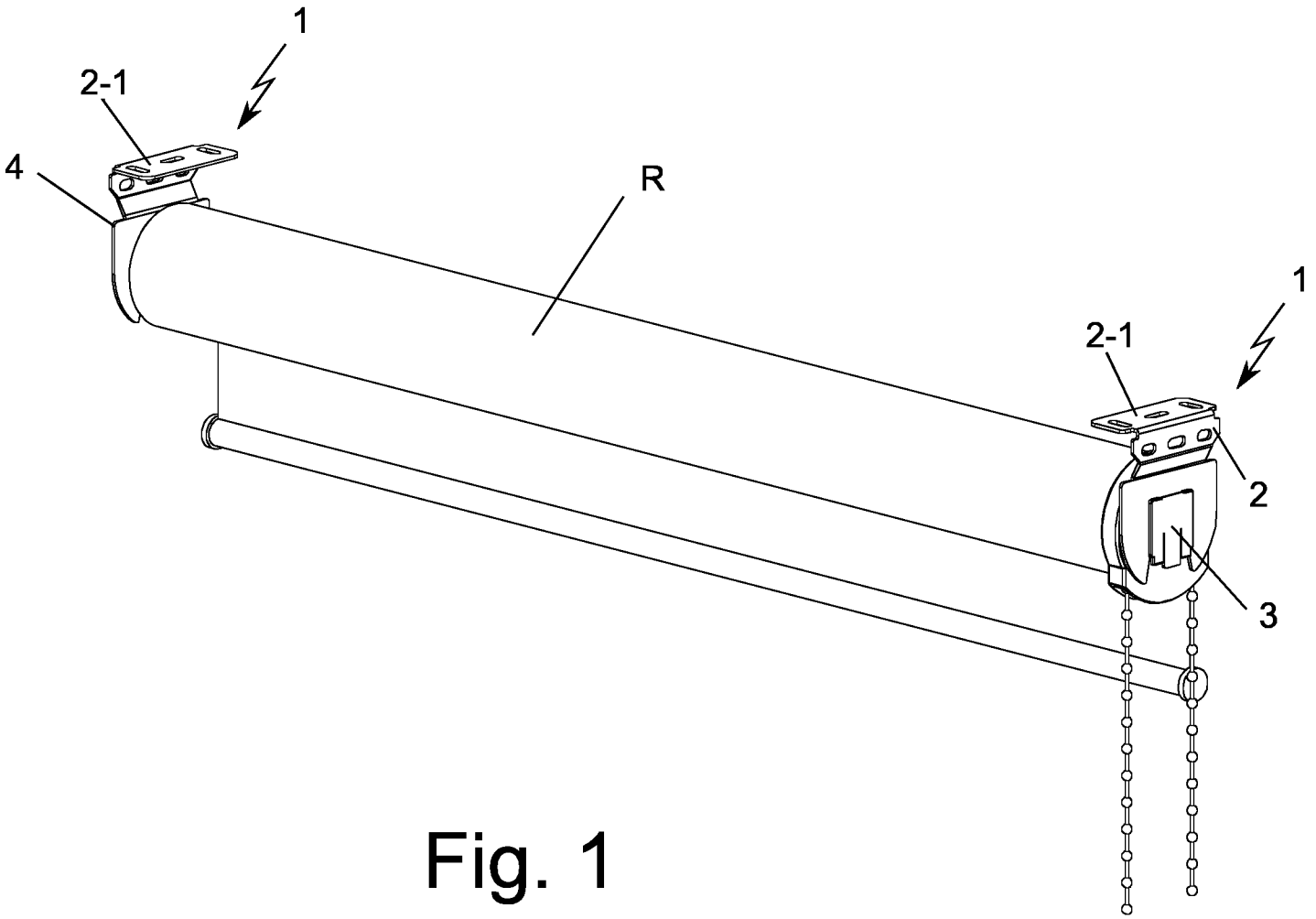

FIG. 1 is an isometric view of a first preferred embodiment of a device 1 according to the invention applied in a roller blind R. Device 1 comprises a mounting bracket 2 and shaft supports 3, 4. Device 1 is situated at both outer ends of the roller blind R. Device 1 is configured for mounting a shaft of a screen, such as a window covering. The screen shaft can be a fixed shaft, for instance a curtain rod. The screen shaft can also be a rotatable shaft for winding up or unwinding fabric of the screen or of cords of the screen. Mounting bracket 2 is configured for mounting on the surface and shaft holder 3 is configured for releasable attachment to mounting bracket 2. Mounting bracket 2 is provided for this purpose with a mounting plate 2-1 with holes, for instance for screws or bolts. Shaft holder 3 is provided with coupling means for coupling the shaft (not shown) of the roller blind. The coupling means comprise a bearing or a pin.

Figure 2B:
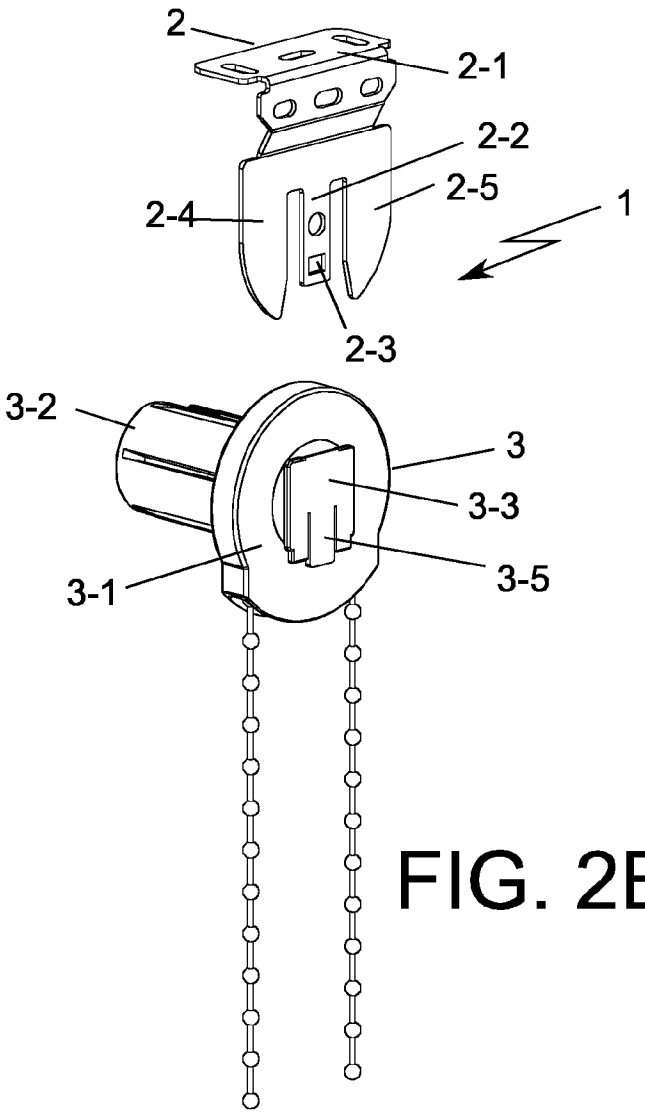
FIG. 2B is an exploded view of the device of FIG. 2A.
Figure 2A:
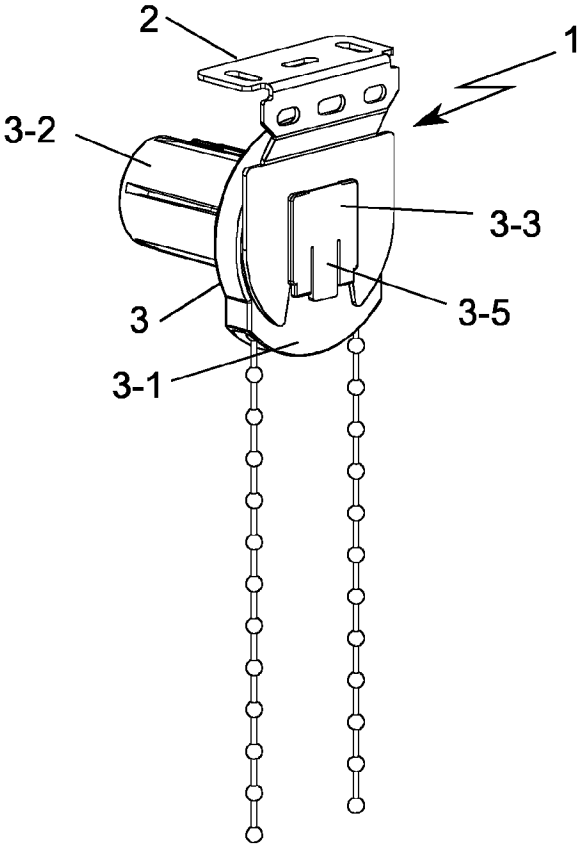
FIG. 2A is an isometric view of the first preferred embodiment of the device according to the invention of FIG. 1, wherein the shaft holder is provided with an operating mechanism for the roller blind.

FIG. 2A is an isometric view of the first preferred embodiment of device 1 according to the invention of FIG. 1, in which shaft holder 3 is provided with an operating mechanism 3-1 for roller blind R. FIG. 2B is an exploded view of device 1 of FIG. 2A. Shaft holder 3 is provided with a connecting piece or pin 3-2 for connecting the shaft of the roller blind R to device 1. Mounting bracket 2 is provided with one locking tooth 2-2 and shaft holder 3 is provided with a corresponding slot which is configured to receive locking tooth 2-2. Because an end plate 3-3 is arranged at a distance from shaft holder 3 using two spacers on shaft holder 3, the space between the two spacers here forms the slot. The position of the slot will become clear in FIG. 4. Shaft holder 3 is provided with a controllable hook arranged on a tongue 3-5 on end plate 3-3. The hook is however not visible in the perspective of this figure. The location and the form of the hook will become clear from the explanation of FIGS. 3A and 3B. Locking tooth 2-2 is provided with a hole 2-3. When locking tooth 2-2 is placed in the slot, the hook will drop into hole 2-3 and shaft holder 3 will be locked to mounting bracket 2. Shaft holder 3 can be unlocked from mounting bracket 2 again by operating the tongue 3-5.

Mounting bracket 2 is also provided with guide teeth 2-4 and 2-5 which engage on both sides of the spacers. Guide teeth 2-4 and 2-5 guide shaft holder 3 in mounting bracket 2. Locking tooth 2-2 and guide teeth 2-4 and 2-5 together form a fork.

Figure 3B:
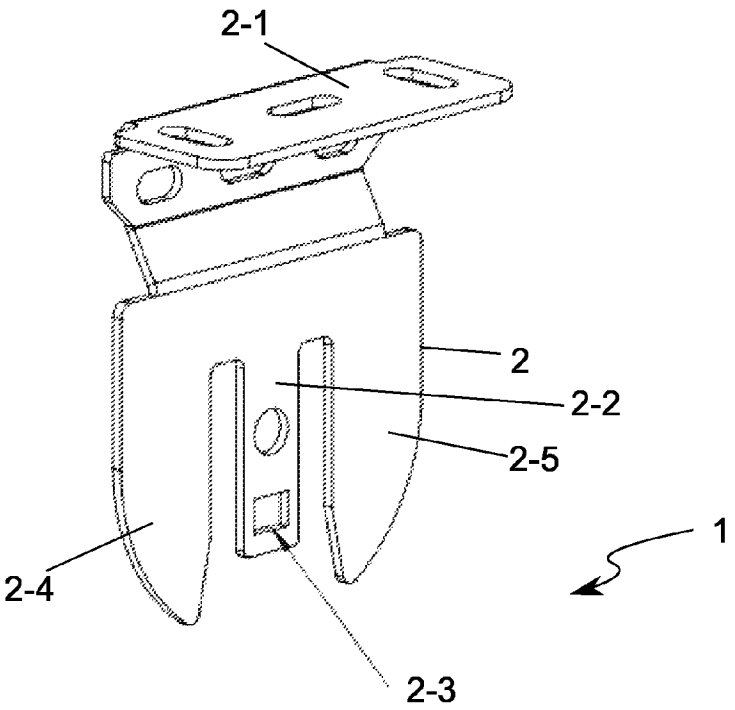
FIG. 3B is an exploded view of the device of FIG. 3A.
Figure 3A:
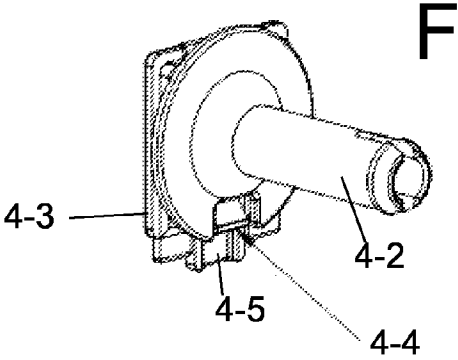
FIG. 3A is an isometric view of the first preferred embodiment of the device according to the invention of FIG. 1, wherein the shaft holder is not provided with an operating mechanism for the roller blind.
Figure 3A:
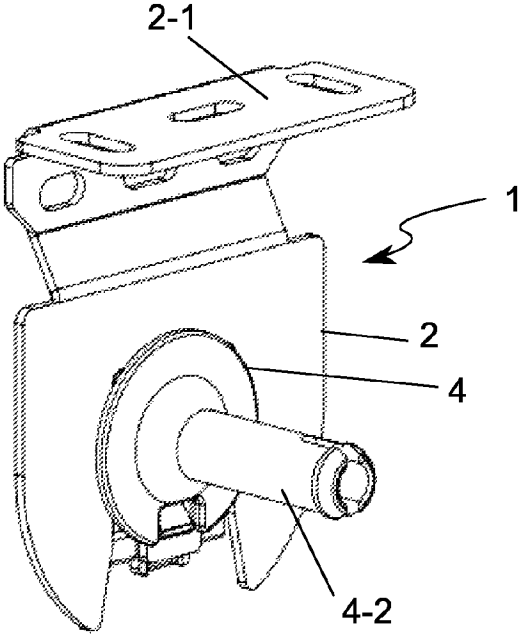

FIG. 3A is an isometric view of the first preferred embodiment of device 1 according to the invention of FIG. 1, wherein shaft holder 4 is not provided with an operating mechanism for roller blind R. FIG. 3B is an exploded view of device 1 of FIG. 3A. Just as shaft holder 3, shaft holder 4 is provided with a connecting piece or pin 4-2 for connecting the shaft of roller blind R to device 1. Shaft holder 4 is also provided with an end plate 4-3 which is arranged with spacers on shaft holder 4 in the same manner as in the case of shaft holder 3.

Figure 3C:
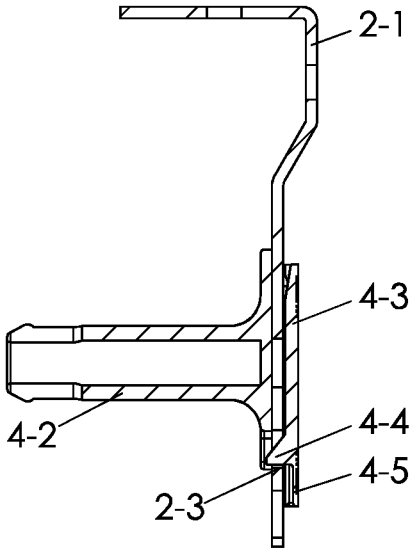
FIG. 3C is a cross-sectional view of the device of FIG. 3A.

Shown in this figure is the hook 4-4 which corresponds to the hook of shaft holder 3. Hook 4-4 is arranged on tongue 4-5 and is shaped such that it drops into hole 2-3 when locking tooth 2-2 drops into the slot of shaft holder 4. This is shown in FIG. 3C which is a cross-sectional view of device 1 in the position of FIG. 3A.

Figure 4:
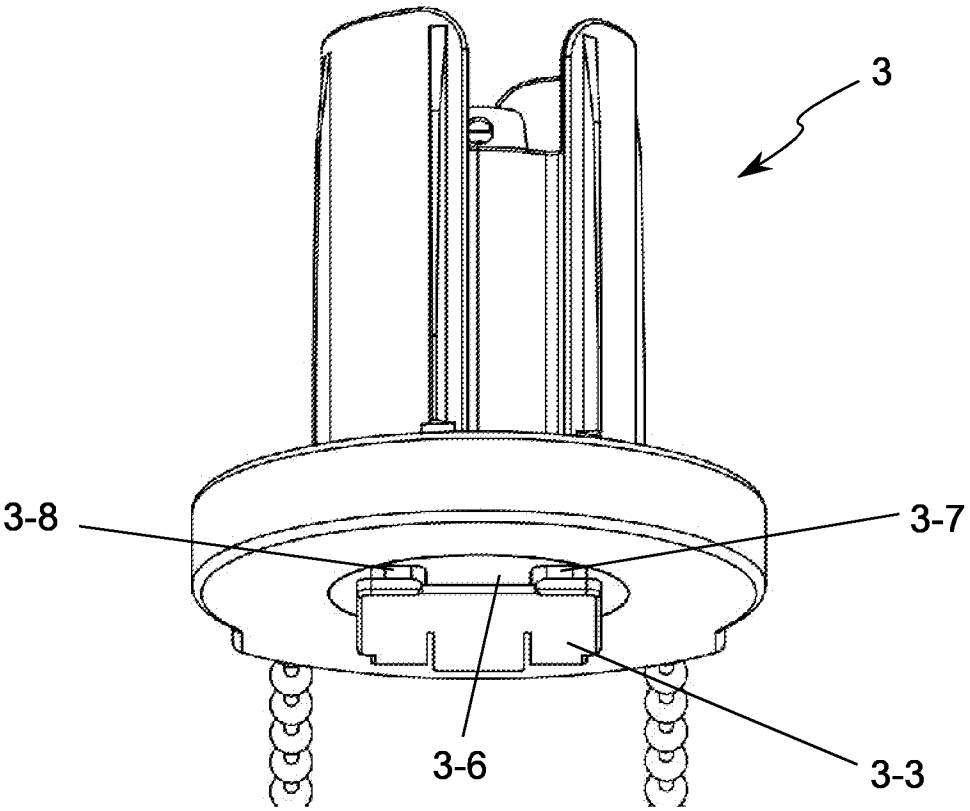
FIG. 4 is a top view of the shaft holder 3 of FIG. 1.

FIG. 4 is a top view of shaft holder 3 of FIG. 1. The position of slot 3-6 is shown in this figure. Because an end plate 3-3 is arranged on shaft holder 3 at a distance from shaft holder 3 using two spacers 3-7 and 3-8, the space between the two spacers 3-7 and 3-8 here forms the slot 3-6. The distance between spacers 3-7 and 3-8 is of course a minimum of the width of locking tooth 2-2. The width of each spacer 3-7 and 3-8 corresponds to the space between locking tooth 2-2 and guide tooth 2-4 or 2-5.

The shaft holder 3 shown in FIG. 2 is provided with an operating mechanism for operating a roller blind and forms the right-hand shaft holder 3 of FIG. 1. It will be apparent to the skilled person that the left-hand shaft holder 4 of FIG. 1 has the same form and operation as the right-hand shaft holder, but has no operating mechanism for the roller blind.

The invention is of course not limited to the described and shown preferred embodiments but extends to any embodiment falling within the scope of protection as defined in the claims and as seen in the light of the foregoing description and accompanying drawings.

The invention claimed is:

1. Device for mounting a rotatable shaft of a screen on a surface, wherein the device comprises a mounting bracket and a shaft holder, wherein the mounting bracket is configured for mounting on the surface and the shaft holder is attachable to the mounting bracket, wherein the shaft holder is provided with coupling means for coupling the rotatable shaft of the screen, wherein the coupling means comprise a pin for connecting the shaft of the screen, and the shaft holder is releasably attachable to the mounting bracket, wherein the mounting bracket is provided with at least one locking tooth, wherein the shaft holder is provided with at least one slot, wherein the at least one slot is configured to receive the at least one locking tooth and the shaft holder and the mounting bracket are provided with co-acting locking means for releasably locking the at least one locking tooth in the at least one slot, wherein an end plate arranged at a distance on the shaft holder using at least two spacer blocks is attached to the shaft holder, wherein the at least one slot for receiving the at least one locking tooth is formed between the at least two spacer blocks, the end plate and a back surface of the shaft holder opposite the coupling means, wherein the end plate is provided at the position of the at least one slot with a user-accessible and controllable hook, and the at least one locking tooth is provided with a hole intended for the purpose of at least partially receiving the hook and wherein the hook and the hole form the locking means, wherein the controllable hook is arranged on a tongue in the end plate opposite to an entrance of the slot for receiving the at least one locking tooth;

wherein the mounting bracket is further provided with guide teeth for engaging on both outer sides of the spacer blocks, said guide teeth forming a fork together with the at least one locking tooth, wherein the distance between the at least one locking tooth and an adjacent guide tooth corresponds to the width of one of the spacer blocks; and wherein both the width of the end plate and the width of the back surface are larger than the width of the at least two spacer blocks plus the width of the slot between the at least two spacer blocks, thereby forming additional slots for the guide teeth between the outer sides of the spacer blocks, the end plate and the back surface.

2. Device according to claim 1, wherein the distance between the spacer blocks corresponds to the width of the at least one locking tooth.

3. Device according to claim 1, wherein the width of the fork is larger than both the width of the end plate and the width of the back surface.

4. Device according to claim 1, wherein the width of each guide tooth is larger than the width of the locking tooth.

5. Device according to claim 1, wherein each guide tooth is longer than the locking tooth.

* * * * *